US006252578B1

(12) United States Patent
Hsieh et al.

(10) Patent No.: US 6,252,578 B1
(45) Date of Patent: Jun. 26, 2001

(54) METHOD FOR REDUCING FLICKER WHEN DISPLAYING PROCESSED DIGITAL DATA ON VIDEO DISPLAYS HAVING A LOW REFRESH RATE

(75) Inventors: Minjhing Hsieh, San Jose; Bowei Hsu, Cupertino; Jeffrey F. Schier, Oakland, all of CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 08/946,326

(22) Filed: Oct. 7, 1997

(51) Int. Cl.[7] ..... G09G 5/04

(52) U.S. Cl. ..... 345/136; 345/138; 345/147; 345/432; 345/509

(58) Field of Search ..... 345/136, 138, 345/147, 432, 509

(56) References Cited

U.S. PATENT DOCUMENTS

| | | | | |
|---|---|---|---|---|
| 3,845,243 | | 10/1974 | Schmersal et al. | 178/7.3 D |
| 3,937,878 | | 2/1976 | Judice | 178/7.3 |
| 4,011,556 | | 3/1977 | Tochitani et al. | 340/324 |
| 4,021,607 | | 5/1977 | Amano | 358/230 |
| 4,074,254 | | 2/1978 | Belser et al. | 340/324 |
| 4,180,813 | | 12/1979 | Yoneda | 340/784 |
| 4,193,095 | | 3/1980 | Mizushima | 358/241 |
| 4,233,601 | | 11/1980 | Hankins et al. | 340/703 |
| 4,237,457 | * | 12/1980 | Houldsworth | 345/147 |
| 4,427,978 | | 1/1984 | Williams | 340/784 |
| 4,486,785 | | 12/1984 | Lasher et al. | 358/284 |
| 4,559,535 | | 12/1985 | Watkins et al. | 340/793 |
| 4,591,844 | * | 5/1986 | Hickin et al. | 345/147 |
| 4,612,540 | * | 9/1986 | Pratt | 345/147 |
| 4,660,030 | | 4/1987 | Maezawa | 340/784 |
| 4,694,348 | | 9/1987 | Kamiya et al. | 358/236 |
| 4,695,884 | | 9/1987 | Anastassiou et al. | 358/163 |
| 4,743,096 | | 5/1988 | Wakai et al. | 350/333 |
| 4,779,083 | | 10/1988 | Ishii et al. | 340/767 |
| 4,845,473 | | 7/1989 | Matsuhashi et al. | 340/784 |
| 4,849,746 | * | 7/1989 | Dubner | 345/147 |
| 4,860,246 | | 8/1989 | Inoue | 364/900 |
| 4,864,290 | | 9/1989 | Waters | 340/793 |
| 5,017,914 | | 5/1991 | Uchida et al. | 340/784 |
| 5,028,917 | | 7/1991 | Imanishi et al. | 340/793 |
| 5,068,649 | | 11/1991 | Garrett | 340/793 |
| 5,136,385 | | 8/1992 | Campbell | 358/160 |
| 5,185,602 | | 2/1993 | Bassetti, Jr. et al. | 340/793 |
| 5,245,328 | | 9/1993 | Garrett | 345/149 |
| 5,428,456 | | 6/1995 | Parulski et al. | 358/340 |
| 5,489,921 | * | 2/1996 | Dorff et al. | 345/153 |
| 5,748,178 | * | 5/1998 | Drewry | 345/138 |
| 5,821,915 | * | 10/1998 | Graham et al. | 345/136 |
| 5,953,020 | * | 9/1999 | Wang et al. | 345/513 |

* cited by examiner

*Primary Examiner*—Bipin Shalwala
*Assistant Examiner*—Vincent E. Kovalick
(74) *Attorney, Agent, or Firm*—Thelen Reid & Priest LLP; David B. Ritchie

(57) ABSTRACT

An apparatus for processing digital display data is described, wherein the digital display data has a fixed number of pixels in each display line, and the apparatus has a horizontal averaging means and a vertical averaging means. The horizontal averaging means identifies pixel data corresponding to a first pixel, a second pixel, and a third pixel, where the first, second, and third pixels are consecutive pixels in the same line of display data, and then smoothes the intensity values of the first, second, and third pixels, after which the smoothed values are stored. The vertical averaging means for identifies pixel data corresponding to a fourth and fifth pixels, where the fourth and fifth pixels are vertically adjacent to each other, and then smoothes the intensity values of said fourth and fifth pixel data, and storing the resulting smoothed values.

6 Claims, 4 Drawing Sheets

METHOD FOR REDUCING FLICKER WHEN DISPLAYING PROCESSED DIGITAL DATA ON VIDEO DISPLAYS HAVING A LOW REFRESH RATE

BACKGROUND OF THE INVENTION

1. Field of the Invention

This invention relates to the field of analog and digital displays. More particularly, this invention provides a method and apparatus for reducing flicker when displaying processed digital data on video displays having a low refresh rate.

2. Background

It is sometimes necessary to display digital video information on interlaced video displays having refresh rates below 60 Hz. In these cases, if an image is improperly filtered, as is common in graphics originating on personal computers, the display image will flicker. Visual perception of this flicker increases as the contrast between adjacent lines increases. Thus, it is often necessary that images be processed in order to reduce the flicker.

Digital video information is typically organized as pixels, the smallest piece of digital video information. Although each pixel in an image is a fixed number of bits, depending on the color depth of the information, the number of bits each pixel requires may vary. For instance, a pixel may be 8 bits wide (one byte), as when defining any one of 256 shades of gray (from complete black to complete white), 15 or 16 bits wide (covering 256 different colors of 256 different intensities), or may be 24 bits wide (one byte for each color component red, green, and blue, thus allowing for millions of colors).

Digital information is typically stored in a rectangular array of memory locations, but may be stored in any format, depending on the circumstances. For the convenience of discussion, it is assumed here that the digital display data to be processed is stored in a rectangular memory array having a width equal to the number of bytes a display line is wide, and a height equal to the number of vertical display lines.

Typical prior art systems which display digital data on low refresh rate video displays retrieve the data from memory one display line at a time, storing the data in an external line buffer having enough memory to store several lines of display data. Following any desired processing, the resulting video data is then provided to an National Television Standards Committee (NTSC) or Phase Alternating Line (PAL) encoder to generate a composite video signal which is then displayed.

Although the prior art process described above is useful for its intended purposes, the storage of several lines of digital video data and any subsequent processing takes place in an external line buffer.

Another disadvantage of prior art systems is that large amounts of valuable memory space is required to store and process several lines of data at a time.

OBJECTS AND ADVANTAGES OF THE INVENTION

Accordingly, it is an object of the present invention to provide a method and apparatus for processing digital video information which does not require an external line buffer.

It is a further object of the present invention to provide a method and apparatus for processing digital video information which has a low memory requirement.

These and many other objects and advantages of the present invention will become apparent to those of ordinary skill in the art from a consideration of the drawings and ensuing description of the invention.

SUMMARY OF THE INVENTION

An apparatus for processing digital display data is described, wherein the digital display data has a fixed number of pixels in each display line, and the to apparatus has a horizontal averaging means and a vertical averaging means. The horizontal averaging means identifies pixel data corresponding to a first pixel, a second pixel, and a third pixel, where the first, second, and third pixels are consecutive pixels in the same line of display data, and then smoothes the intensity values of the first, second, and third pixels, after which the smoothed values are stored. The vertical averaging means for identifies pixel data corresponding to a fourth and fifth pixels, where the fourth and fifth pixels are vertically adjacent to each other, and then smoothes the intensity values of said fourth and fifth pixel data, and storing the resulting smoothed values.

DESCRIPTION OF THE PREFERRED EMBODIMENTS

Those of ordinary skill in the art will realize that the following description of the present invention is illustrative only and is not intended to be in any way limiting. Other embodiments of the invention will readily suggest themselves to such skilled persons from an examination of the within disclosure.

The present invention involves the display of digital information on an interlaced, low-refresh rate display such as a television set. It is contemplated that the information being supplied to the display will substantially change over time, such as seen with home videos, motion pictures, and the like. It is therefore necessary that the apparatus and method described herein be capable of high data throughputs.

Although several embodiments of the present invention exist which would accomplish the same goal of smoothing the intensity values of the various color elements making up a group of pixels, it is preferred that pixel data be retrieved from display memory such as described herein so as to make averaging operations easy to manage and to minimize the memory requirements.

Figure 1:
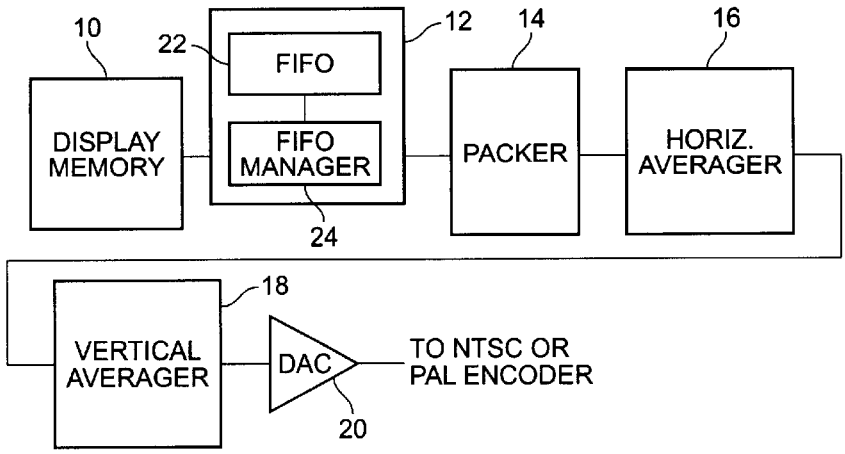
FIG. 1 is a block diagram of a preferred embodiment of the present invention.

FIG. 1 is a block diagram of a preferred embodiment apparatus of the present invention.

Referring to FIG. 1, a display memory 10 contains digital video information to be processed and displayed. Coupled to display memory 10 is first in first out (FIFO) circuits 12 which handles the accessing of video data stored in display memory 10, thus retrieving video data in segments, and providing those data segments to packer 14. Packer 14 then breaks the data segments into individual pixels and provides the pixel data to horizontal averager 16 and vertical averager 18 so that necessary averaging functions may be performed. Following these functions being performed, the resulting digital data is then converted to analog form using Digital to Analog (D/A) converter 20. The output of D/A converter 20 is then provided to a display.

The main idea here is to provide an apparatus and method for organizing the video data in such a way as to be able to perform processing functions without having to deal with entire lines of video data at a time. The present invention accomplishes this goal by separating each video line into segments which themselves contain memory words, with each memory word containing one or more pixels.

A more detailed examination of the processing apparatus and steps involved with the method of the present invention will now be presented. For the present discussion, the "current" line of the display will be the topmost line currently being operated upon, and the "next" line will the line of the display immediate following the "current" line. For instance, if line 1 of the display is the "current" line, then line 2 of the display is the "next" line. It is preferred that the process described herein begin with the current line being line 1 of the display, thus designating line 2 as the next line. As the method proceeds, the current line and the next line will be incremented by one, eventually causing all lines of display memory 10 to be processed.

The preferred embodiment of the present invention retrieves data from display memory in segments, with a segment being defined as a portion of a line of the video display. In low resolution modes, such as in 640×480 pixels, the number of segments a video line is divided into may only be 2, whereas when using higher density modes such as 1024×768 pixels, the number of segments per line may be as many as 16.

Figure 2:
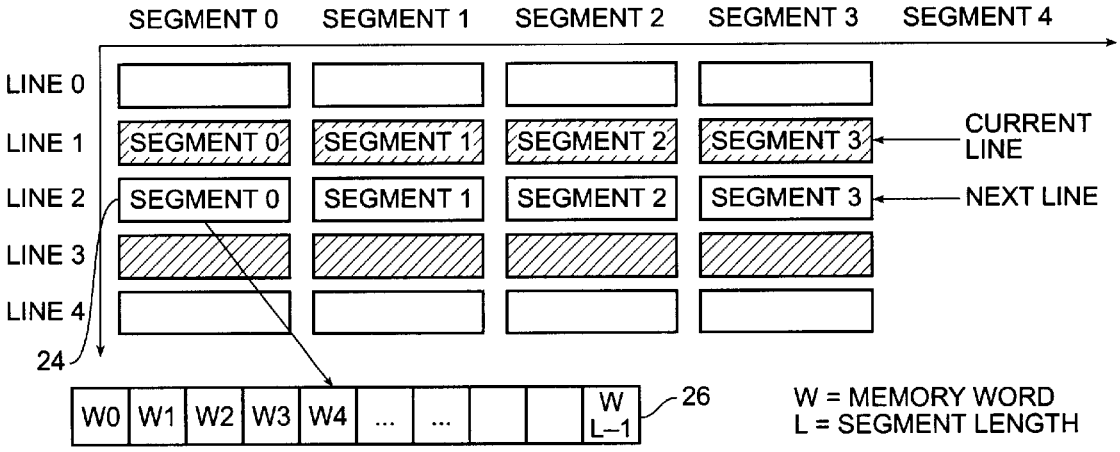
FIG. 2 is a diagram showing the segmentation of the video display according to a presently preferred embodiment of the present invention.

FIG. 2 is a diagram showing the segmentation of the video display according to a presently preferred embodiment of the present invention.

Referring to FIGS. 1 and 2, FIFO circuits 12 comprise a FIFO memory 22 and a FIFO manager 24. FIFO manager 24 accesses display memory 10, and retrieves data stored there in segments such as segments 26 which is comprised of several memory words, such as seen in segment 26. The size of each memory word is a fixed size, but the common word may vary depending on designers choice.

After the data is retrieved from display memory 10, the data is reorganized prior to it being provided into the FIFO. The presently preferred embodiment uses a 64-bit FIFO word size and a 32 word capacity, although other word sizes and capacities may be used without departing from the scope and spirit of the present invention.

Figure 3:
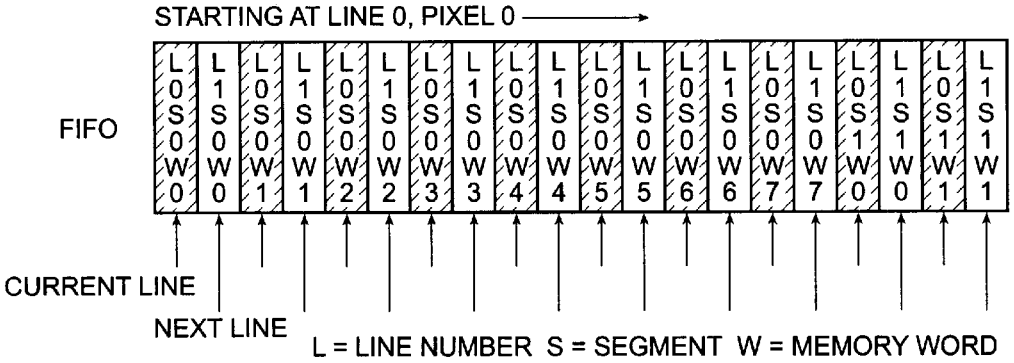
FIG. 3 is a table showing the output of the FIFO for an 8-Bit color depth according to a presently preferred embodiment of the present invention.

FIG. 3 is a diagram showing the organization of data in the FIFO according to a presently preferred embodiment of the present invention.

Referring to FIG. 3, a portion of FIFO 22 is shown filled with video data. The convention used in the figure is line number, followed by segment number, followed by word number. Recall that each segment retrieved from display memory 10 comprises many memory words. The proper memory words are separated and reorganized by FIFO manager 24 and then loaded into FIFO memory 22, resulting in the diagram of FIG. 3. Seen here is the Line 0 Segment 0 Word 0, followed by Line 1 Segment 0 Word 0, etc. until lines 1 and 2 have been fully processed. Line 2 is then designated as the "current" line, and the process continues with lines 2 and 3 being retrieved, lines 3 and 4, lines 4 and 5, etc. until all data for all lines of the display have been loaded into the FIFO.

Recall that not all data is present in the FIFO at the same time, since data is caused to be removed from the FIFO by packer 14. Thus, the 64×32 bit FIFO used in the presently preferred embodiment of the present invention solves the memory usage problems of the present invention as well as being able to be provided within a personal computer without sacrificing much real estate inside the computer.

Recall that each memory word comprises one or more pixels. The output of the FIFO 22 is provided to packer 14 which further organizes the memory words of FIG. 3 into pixels so that the averaging functions may be performed without consuming large amounts of memory, resulting in an output such as that seen in FIGS. 4 through 6 depending on the color depth of the image being processed.

The output of packer 14 comprises the first pixel of the current line of the display, followed by the first pixel of the next line of the display. Proceeding further, the second pixel of the first line of the display is provided to the data stream, followed by the second pixel of the second line of the display. This process is followed until the last pixel of the last line of the display has been provided to the data stream, at which time line 2 is processed as if it were the current line. The process continues in this fashion until all pixels have been provided into the data stream.

The preferred embodiment of the present invention utilizes a 64-bit wide register for processing and moving data between process steps. Those of ordinary skill in the art will readily recognize that any size register will work, without departing from the scope and spirit of the present invention.

The process above is designed to provide an output to downstream processes which appears to be a serial input to those processes. Thus, by the time the end of the first line of display memory has been retrieved and provided to the data stream, the first several pixels have likely already been operated on by later processes, and may have already been provided to the analog video display for viewing by a user of the system.

Figure 4:
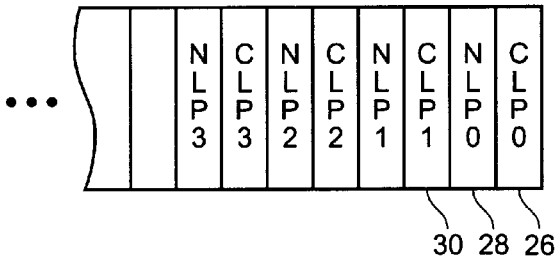
FIG. 4 is a table showing the output of the packing circuit for an 8-bit color depth according to a presently preferred embodiment of the present invention.

FIG. 4 is a table showing the output of the packing circuit for an 8-bit color depth according to a presently preferred embodiment of the present invention.

It is important to understand that FIG. 4 represents the output resulting from packer 14 retrieving the data for any two display lines having an 8-bit color depth. For the purposes of this discussion, CL refers to the line designated as the current line, and P0, P1, etc. refers to pixel 0, pixel 1, pixel 2, etc. within that current line. Correspondingly, NL refers to the "next line", or the line which immediately follows the current line.

The functions performed by packer 14 may be implemented either in hardware or in software. Those of ordinary skill in the art will readily recognize many ways to implement the described functions without departing from the scope and spirit of the present invention described herein.

Referring to FIG. 4, the output of packing circuit 14 begins with the first pixel of the first line, or "current line pixel 0" 26, followed by "next line pixel 0" 28, "current line pixel 1" 30 and so on, until all of the pixels for the current line and the next line have been processed. Packer 14 then operates on the data as if the former next line became the current line, and the line following it in display memory became the next line. The data is processed by the packer 14 until all lines of video data have been provided into the data stream.

As stated earlier, analog displays require an analog signal to operate properly. In order to provide that signal, D/A converter 20 is provided data from the output of the horizontal or vertical averagers and converts that serial input to an analog output. The data may then be further processed, or may be converted to NTSC or PAL format as necessary, then provided to the analog display.

In addition to providing the data in a format required by the analog display, processing the digital data serially keeps the processing overhead low as compared to processing larger amounts of data at a time, keeping the throughput high. High throughput allows the processing circuitry to provide data to D/A converter 18 at or above the video display rates utilized by the display.

Figure 5:
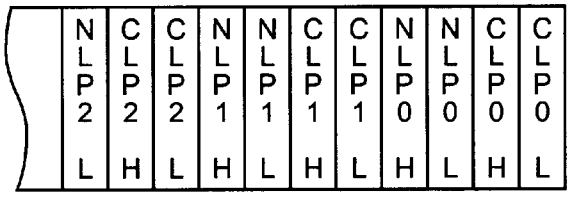
FIG. 5 is a table showing the output of the packing circuit for an 15/16-bit color depth according to a presently preferred embodiment of the present invention.

FIG. 5 is a table showing the output of the packing circuit for an 15/16-bit color depth according to a presently preferred embodiment of the present invention.

Referring to FIG. 5, it is seen now that because pixels are now 15 or 16 bits wide, instead of 8 bits wide as in the previous example. Thus, the output of packer 14 begins with the lower 8 bits of CLP0 (bits 0–7), followed by the upper 8 bits of CLP0 (bits 8–15). The packer 14 then follows the CLP0 data with the NLP0 data. The primary difference between the 8-bit and 15/16-bit implementations is that twice as much memory is required for storing all of the display information. The low bits may precede the high bits or vice-versa, without departing from the scope and spirit of the present invention.

Figure 6:
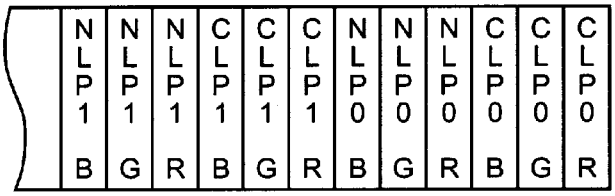
FIG. 6 is a table showing the output of the packing circuit for an 24-bit color depth according to a presently preferred embodiment of the present invention.

FIG. 6 is a table showing the output of the packing circuit for an 24-bit color depth according to a presently preferred embodiment of the present invention.

Referring to FIG. 6, it is seen now that each pixel is now 24 bits wide, and contains information for all three components (Red, Green, and Blue) making up a typical video signal. The output of the packer circuit 14 begins with the red component of CLP0, followed by the Green and Blue components, as seen in the figure.

For convenience, the preferred method and apparatus embodiments of the present invention require that the output of packer 14 be provided to the averaging circuits 16 and 18 in 24-bit format. This is to provide a common format to the averaging circuits, thus minimizing the different number of sub-circuits, one for each different color depth. However, it is within the capabilities of those of ordinary skill in the art to provide the data to the averaging circuits in many different formats, without departing from the scope and spirit of the present invention.

When using the preferred embodiment of the present invention with video display data having an 8-bit color depth, the output of the packing circuit 14 is padded with 16-bits of "don't care" information after each 8-bit byte of valid video information is provided to the averaging circuits. "Don't care" information is merely information bits which are randomly high or low, and which are not used when outputting the final video signal on the display.

Correspondingly, when using a 15-bit color depth, nine "don't care" bits are input into the data stream as the valid data is provided to the averaging circuits. When using a 16-bit color depth, eight bits of "don't care" information are input into the data stream as the valid data is provided to the averaging circuits.

Referring back to FIG. 1, the output of packing circuit 14 is provided to vertical averaging circuit 16. It will be recognized by those of ordinary skill in the art that using the data format specified, vertical averaging is performed first, in order to provide a higher throughput than if horizontal averaging were performed first. However, embodiments are contemplated wherein horizontal averaging would be performed prior to vertical averaging. Embodiments are also contemplated wherein vertical averaging is performed without a horizontal averaging step, and where three vertical lines are averaged, ¼ weight given to the first line, ½ weight given to the second line, and ¼ weight given to the third line.

Figure 7A:
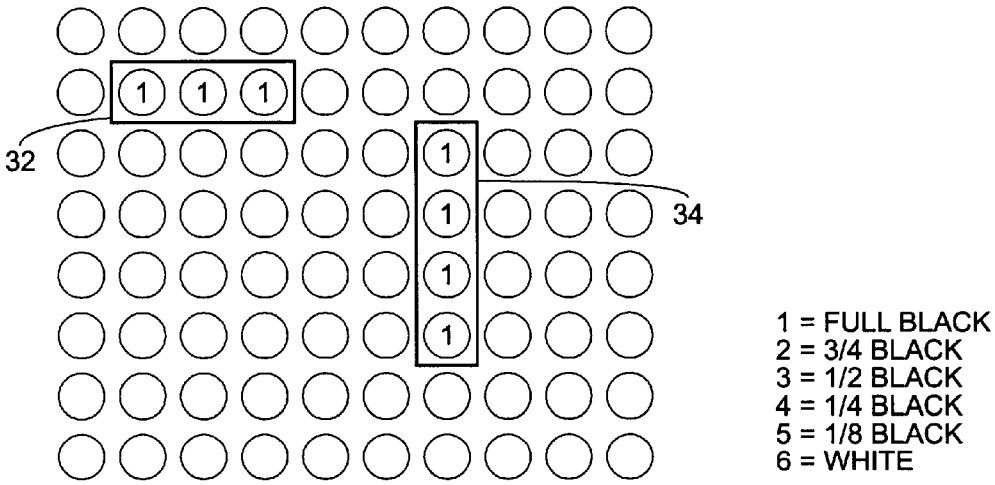
FIG. 7A shows a simple arrangement of pixels prior to any averaging functions.

FIG. 7A shows a simple arrangement of 8-bit pixels prior to any averaging functions.

Referring to FIG. 7A, a 10 by 8 arrangement of pixels is shown. A horizontal line 32 and vertical line 34 will be used to depict the averaging process.

Figure 7B:
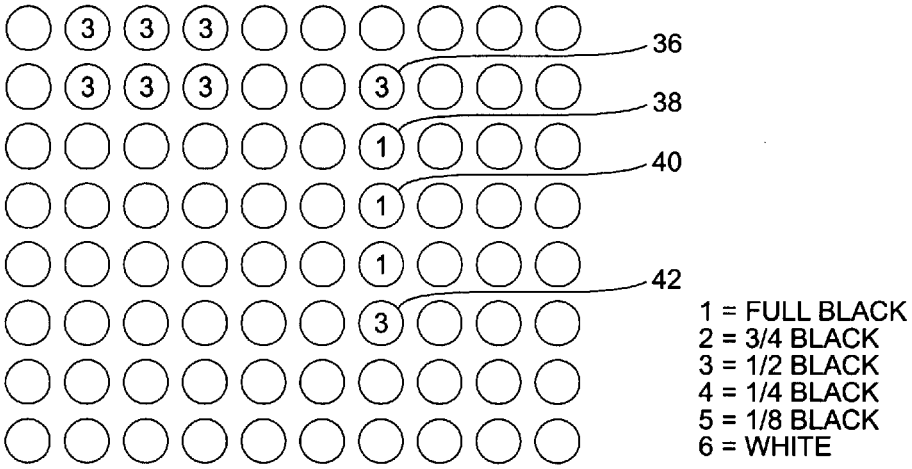
FIG. 7B shows the arrangement of pixels originally depicted in FIG. 7A, but after vertical averaging has taken place.

FIG. 7B shows the arrangement of 8-bit pixels originally depicted in FIG. 7A, after vertical averaging has taken place.

In the preferred embodiment of the method and apparatus of the present invention, vertical averaging comprises the simple averaging of one pixel with the pixel below. Thus, using the convention described earlier, the value of CLP0 is added to the value of NLP0 and the result divided by 2. That result is then placed into the output of the averager as the new value for CLP0. Later in the process, the current NLP0 will be designated as a "new" CLP0 and averaged with the line below (then designated as NLP0).

Referring to FIG. 7B, the results of averaging the entire set of pixels from FIG. 7A is shown. Note that the horizontal line 32 which comprised three full black pixels in FIG. 7A has now been averaged, and is now at ½ black. Correspondingly, vertical line 34 shows the changes associated with vertical averaging. Pixel 36 (CLP7) had an original value of "0" or white, and pixel 38 (NLP7) had an original value of "1", or full black. To average the two values, you add the two getting a result of 0+1=1, and then divide by 2 to get ½. The value of ½ then is placed in the data stream for pixel 36, replacing the previous value of white seen before vertical averaging.

When pixel 38 (now CLP7) and pixel 40 (NLP7) are vertically averaged, ou get (1+1)/2=1. Thus the original value for pixel 38 and the vertically veraged value are the same, i.e. full black. However, note that pixel 42 has now changed from full black to ½ black due to the averaging process. This movement towards the middle gray level serves to diminish the stark contrast between pixels which tends to cause display flicker.

Figure 7C:
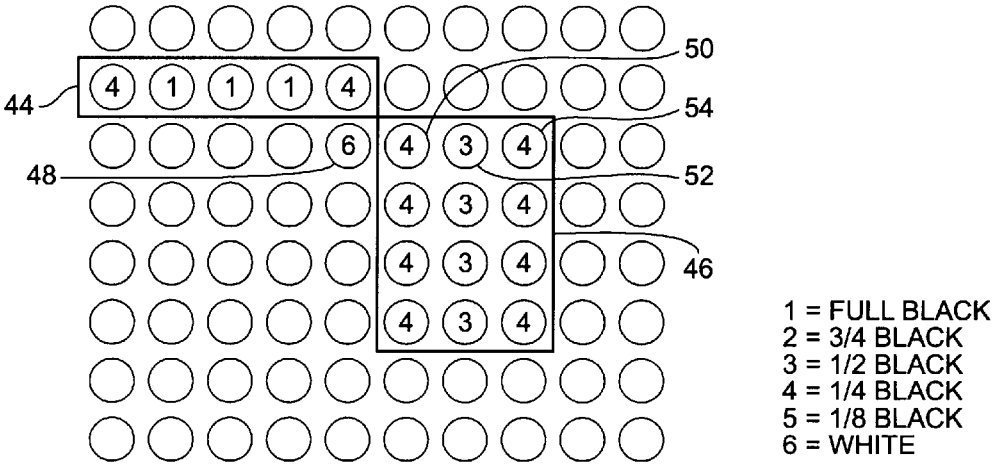
FIG. 7C shows the arrangement of 8-bit pixels originally depicted in FIG. 7A, after horizontal averaging has taken place.

FIG. 7C shows the arrangement of 8-bit pixels originally depicted in FIG. 7A, after horizontal averaging has taken place.

In the preferred embodiment of the method and apparatus of the present invention, horizontal averaging comprises a weighted average of three horizontally adjacent pixels, with the result being provided to the data stream in the position of the middle of the three adjacent pixels. When performing the horizontal average, the first and third pixels in a three pixel series are given a weight of ¼, and the second pixel in the series is given a weight of ½. Thus, one quarter of the value of CLP6 is added to one-half of the value of CLP7 and one quarter of the value of CLP8. The resulting sum is then placed into the output of the averager as the new value for CLP7.

Referring to FIG. 7C, the results of horizontally averaging the entire set of pixels from FIG. 7A is shown. Note that the horizontal line 32 which comprised three full black pixels in FIG. 7A has been horizontally averaged and appears as line 44 in FIG. 7C, presenting a diminished contrast differential across the 5 pixels of line 44. Correspondingly, vertical line 34 of FIG. 7A has now become a group of pixels 46 in FIG. 7C presenting the changes associated with horizontally averaging a vertical line of pixels.

Although all other pixels in the display are averaged in the same manner, pixel 50 will be averaged as an example of horizontal averaging. Pixel 48 had an original value of "0" or white, pixel 50 had an original pixel value of "0", and pixel 52 had an original value of "1" or black. The weighted average is then (¼*0)+(½*0)+(¼*1)=¼. Thus, the pixel value of ¼ is placed in the data stream corresponding to the center of the three pixels, pixel 50. All other pixels are averaged in the same manner and inserted into the data stream at the appropriate points in the averaging process.

Figure 7D:
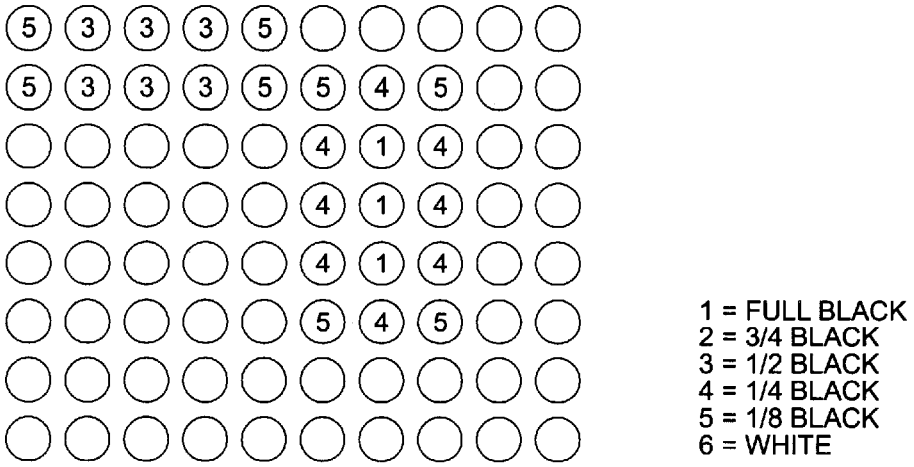
FIG. 7D shows the arrangement of 8-bit pixels originally depicted in FIG. 7A, after both vertical and horizontal averaging has taken place.

FIG. 7D shows the arrangement of 8-bit pixels originally depicted in FIG. 7A, after both vertical and horizontal averaging has taken place.

Referring to FIG. 7D, the results of performing horizontal and vertical averaging as described herein is shown. Either type of averaging may be performed first, with the other type being performed second. The results as seen in FIG. 7D will be seen regardless of which type of averaging takes place first.

Averaging with a 15/16-bit color depth or a 24-bit color depth is similar. The primary difference is that corresponding bytes are averaged. For instance, in a 15/16-bit color depth, the high bytes are averaged together, and the low bytes are averaged together. When using 24-bit averaging, the data bytes representing the red color component are averaged together, as are the data bytes representing the green color component, and the data bytes representing the blue color component.

FIGS. 8A through 8D comprise the visual effect of the averaging process described herein.

Figure 8A:
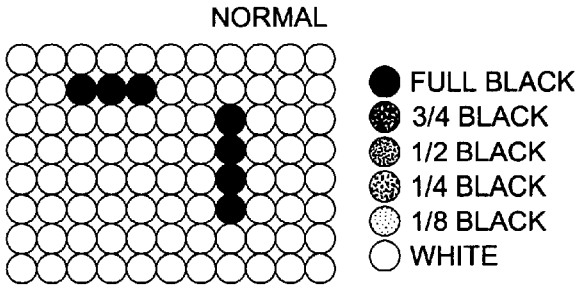
FIGS. 8A through 8D comprise the visual effect of the averaging process described herein.
Figure 8B:
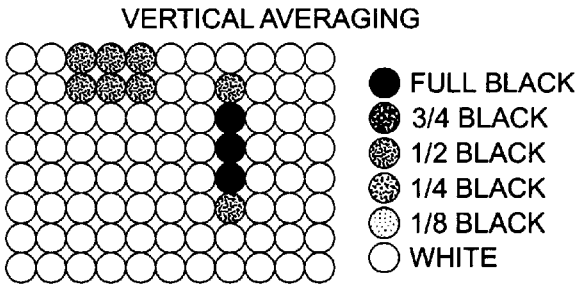
Figure 8C:
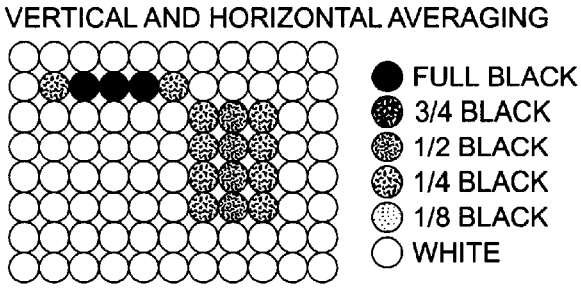
Figure 8D:
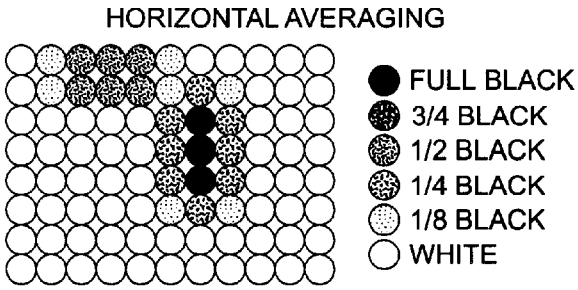

FIG. 8A corresponds to the previously described FIG. 7A. FIGS. 8B through 8D correspond to FIGS. 7B through 7D.

Those of ordinary skill in the art will readily recognize that the method for processing digital data described herein may be performed in many ways other than described herein without departing from the scope and spirit of the present invention. For instance, a software program may retrieve digital data from memory multiple bytes at a time, output the data to averagers in a fashion similar to that seen in the output of packer 14, average the proper pixel data as required, and then either send the averaged data to a D/A converter for conversion to analog prior to display, or write the averaged data back into memory. The software may write the processed data back into the original display memory, or may write the processed data into a second display.

An additional alternative embodiment contemplated by the inventors performs the vertical averaging step prior to the horizontal averaging step, rather than as described herein.

While illustrative embodiments and applications of this invention have been shown and described, it would be apparent to those skilled in the art that many more modifications than have been mentioned above are possible without departing from the inventive concepts set forth herein. The invention, therefore, is not to be limited except in the spirit of the appended claims.

What is claimed is:

1. An apparatus for processing digital display data, said digital display data representing a fixed number of pixels in each display line, the apparatus comprising:

packing means for serially organizing display data as horizontal display data corresponding to pixels in the same horizontal line of display data and as vertical display data corresponding to pixels in the same vertical line of display data:

a horizontal averaging means for identifying pixel data corresponding to a first pixel, a second pixel, and a third pixel, said first, second, and third pixels being consecutive pixels from said horizontal display data, and smoothing the intensity values of said first, second, and third pixel, and storing a resulting smoothed value for said second pixel, wherein said horizontal averaging means performs said smoothing operation by mathematically computing a first sum of one-quarter of the intensity value of the first pixel, one-half of the intensity value of the second pixel, and one-quarter of the intensity value of the third pixel; and a vertical averaging means for identifying pixel data corresponding to a fourth pixel, and a fifth pixel, said fourth and fifth pixels being vertically adjacent pixels from said vertical display data and smoothing the intensity values of said fourth and fifth pixel data, and storing the resulting smoothed values.

2. An apparatus for processing digital display data, said digital display data representing a fixed number of pixels in each display line, the apparatus comprising:

packing means for serially organizing display data as horizontal display data corresponding to pixels in the same horizontal line of display data and as vertical display data corresponding to pixels in the same vertical line of display data:

a horizontal averaging means for identifying pixel data corresponding to a first pixel, a second pixel, and a third pixel, said first, second, and third pixels being consecutive pixels from said horizontal display data, and smoothing the intensity values of said first, second, and third pixel, and storing a resulting smoothed value for said second pixel; and a vertical averaging means for identifying pixel data corresponding to a fourth pixel, and a fifth pixel, said fourth and fifth pixels being vertically adjacent pixels from said vertical display data and smoothing the intensity values of said fourth and fifth pixel data, and storing the resulting smoothed values, wherein said vertical averaging means performs said smoothing operation by computing a second sum of the intensity values of said fourth and fifth pixels and dividing said second sum by two.

3. A method for processing digital display data comprising the steps of:

serially organizing display data as horizontal display data corresponding to pixels in the same horizontal line of display data;

identifying pixel data corresponding to a first pixel, a second pixel, and a third pixel, said first, second, and third pixels being consecutive pixels from said horizontal display data; and smoothing the intensity values of said first, second, and third pixel, and storing a resulting smoothed value for said second pixel, wherein said smoothing operation is accomplished by mathematically computing a first sum of one-quarter of the intensity value of the first pixel, one-half of the intensity value of the second pixel, and one-quarter of the intensity value of the third pixel.

4. A method for processing digital display data comprising the steps of:

serially organizing display data as vertical display data corresponding to pixels in the same vertical line of display data;

identifying pixel data corresponding to a fourth pixel, and a fifth pixel, said fourth and fifth pixels being vertically adjacent pixels from said vertical display data; and smoothing the intensity values of said fourth and fifth pixel data, and storing the resulting smoothed values, wherein said smoothing operation is accomplished by computing a second sum of the intensity values of said fourth and fifth pixels and dividing said second sum by two.

5. A method for processing digital display data comprising the steps of:

serially organizing display data as horizontal display data corresponding to pixels in the same horizontal line of display data and as vertical display data corresponding to pixels in the same vertical line of display data;

identifying pixel data corresponding to a first pixel, a second pixel, and a third pixel, said first, second, and third pixels being consecutive pixels from said horizontal display data;

smoothing the intensity values of said first, second, and third pixel, and storing a resulting smoothed value for said second pixel, wherein said smoothing is accomplished by mathematically computing a first sum of one-quarter of the intensity value of the first pixel, one-half of the intensity value of the second pixel, and one-quarter of the intensity value of the third pixel;

identifying pixel data corresponding to a fourth pixel, and a fifth pixel, said fourth and fifth pixels being vertically adjacent pixels from said vertical display data; and smoothing the intensity values of said fourth and fifth pixel data, and storing the resulting smoothed values.

6. A method for processing digital display data comprising the steps of:

serially organizing display data as horizontal display data corresponding to pixels in the same horizontal line of display data and as vertical display data corresponding to pixels in the same vertical line of display data;

identifying pixel data corresponding to a first pixel, a second pixel, and a third pixel, said first, second, and third pixels being consecutive pixels from said horizontal display data;

smoothing the intensity values of said first, second, and third pixel, and storing a resulting smoothed value for said second pixel;

identifying pixel data corresponding to a fourth pixel, and a fifth pixel, said fourth and fifth pixels being vertically adjacent pixels from said vertical display data; and smoothing the intensity values of said fourth and fifth pixel data, and storing the resulting smoothed values, wherein said smoothing operation is accomplished by computing a second sum of the intensity values of said fourth and fifth pixels and dividing said second sum by two.

* * * * *

UNITED STATES PATENT AND TRADEMARK OFFICE

CERTIFICATE OF CORRECTION

PATENT NO. : 6,252,578
DATED : June 26, 2001
INVENTOR(S) : Minjhing Hsieh; Bowel Hsu; Jeffrey F. Schier It is certified that error appears in the above-identified patent and that said Letters Patent is hereby corrected as shown below:

Title page,
ABSTRACT,
Line 11, delete "for".
Line 12, replace "pixels" with -- pixel --

Column 2,
Line 7, delete "to".
Line 15, delete "for".
Line 16, replace "pixels" with -- pixel --.

Column 3,
Line 16, replace "first in first out" with -- First In First Out --.

Column 6,
Line 56, replace "ou" with -- you --.
Line 57, replace "veraged" with -- averaged --.

Column 8,
Line 16, replace ":" with -- ; --.
Line 43, replace ":" with -- ; --.

Signed and Sealed this

Fifteenth Day of January, 2002

*Attest:*

*Attesting Officer*

JAMES E. ROGAN
*Director of the United States Patent and Trademark Office*